US007128247B2

(12) United States Patent
Retschnig et al.

(10) Patent No.: US 7,128,247 B2
(45) Date of Patent: Oct. 31, 2006

(54) FIRE RESISTANT CERAMIC PART

(75) Inventors: Alexander Retschnig, Leoben (AT); Bernhard Longin, Leoben (AT); Dieter Pirkner, Leoben (AT)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 0 days.

(21) Appl. No.: 10/494,653

(22) PCT Filed: Aug. 1, 2003

(86) PCT No.: PCT/EP03/08535

§ 371 (c)(1),
(2), (4) Date: May 4, 2004

(87) PCT Pub. No.: WO2004/014585

PCT Pub. Date: Feb. 19, 2004

(65) Prior Publication Data

US 2004/0256775 A1 Dec. 23, 2004

(30) Foreign Application Priority Data

Aug. 5, 2002 (DE) ..... 102 35 867

(51) Int. Cl.
*C21C 5/42* (2006.01)

(52) U.S. Cl. ..... 222/594; 266/275

(58) Field of Classification Search ..... 266/275; 222/594

See application file for complete search history.

(56) References Cited

U.S. PATENT DOCUMENTS

| | | | | |
|---|---|---|---|---|
| 6,102,260 | A * | 8/2000 | Heaslip et al. | 222/594 |
| 6,554,167 | B1 * | 4/2003 | Barrett | 222/594 |
| 2002/0011696 | A1 * | 1/2002 | Clark | 266/275 |
| 2002/0033567 | A1 * | 3/2002 | Morales et al. | 266/283 |

FOREIGN PATENT DOCUMENTS

| | | |
|---|---|---|
| EP | 0729 393 B1 | 9/1996 |
| EP | 0790 873 B1 | 8/1997 |
| WO | WO97/37799 | 10/1997 |
| WO | WO00/06324 | 2/2000 |

* cited by examiner

*Primary Examiner*—Scott Kastler
(74) *Attorney, Agent, or Firm*—Christopher L. Parmelee; Walker & Jocke LPA

(57) ABSTRACT

The invention relates to a fire resistant ceramic part which can be embodied in the form of an impact pot or a casting gutter and has the following characteristics:—a base (10);—at least two walls (12, 14) which extend from opposite sections (10*l*, 10*r*) of the base (10) such that at least some sectors (12.1, 12.3, 12.4) of the inner surfaces thereof run at an angle >0 and <90 degrees from a plane E—E, perpendicular to the base (10), and at opposite inclinations;—an opening (O) is configured between free ends (12*r*, 14*r*) of the walls (12, 14);—the distance (dmin, qmin) between the walls (12, 14) is smaller in at least one sector (11) between the base (10) and the opening (O) than it is in the areas (12*u*, 14*u*; 12*o*, 14*o*) located adjacent the opening (O) and the base (10).

19 Claims, 4 Drawing Sheets

FIRE RESISTANT CERAMIC PART

The invention pertains to a refractory ceramic component that may be realized, for example, in the form of an impact pot or a casting gutter (channel).

When molten metal is poured into a tundish, for example, after a ladle treatment, the fairly high flow velocity (for example: 3 m/s) results in significant mechanical stresses on the refractory tundish lining onto which the melt splashes. In addition, turbulences occur at least in the vicinity of the point of impact. The kinetic energy of the stream of molten metal lies at, for example, 2–10 Ws/kg.

In order to maintain the erosion of the regular refractory lining at a minimum, it is common practice to reinforce the impact region of the molten metal with a so-called impact pad.

Such an impact pad may consist of highly erosion-resistant refractory materials.

The utilization of so-called impact pots is also known (WO 00/06324, WO 97/37799, EP 0 729 393 B1, EP 0 790 873 B1).

The base of such an impact pot essentially corresponds to an impact pad. Known impact pots are designed with a reduced cross section in the upper end, i.e., at the location where the molten metal is introduced into and flows out of the impact pot. An "undercut" profile is produced in this fashion.

The invention aims to optimize the construction of a refractory ceramic component of this type in such a way that at least one, preferably all of the following objects are attained:

reduced erosion, directed guidance of the molten metal, minimized flow turbulences, and a simple manufacture.

In order to attain this/these object(s), the invention proposes to realize the component such that the introduced molten metal is deflected in a specific direction and the kinetic energy of the molten metal is simultaneously reduced.

The flow of molten metal should be deflected by a lateral limitation of the component. In order to reduce the kinetic energy, the invention proposes a special alignment/inclination of the corresponding inner surfaces of the limiting walls.

The kinetic energy can be reduced by means of a diffusor effect, for example, with a component that has a funnel-shaped design when viewed in the form of a vertical section (the term "funnel-shaped" refers to the inner, open cross section of the component, into which the molten metal is introduced).

The degree of energy dissipation depends on the angle of inclination of the inner wall surfaces.

These aspects apply to components that are realized in the form of a gutter, i.e., with a base and two opposing lateral walls. However, they also apply to pot-shaped components independently of the (horizontal) cross-sectional geometry, for example, to impact pots with a more or less circular, oval or rectangular inner cross section.

The invention generally proposes a refractory ceramic component with the following characteristics:

a base, at least two walls, the walls extend from opposing sections of the base such that at least segments of their inner surfaces are oppositely inclined by an angle >0 and <90 degrees referred to a plane that extends perpendicular to the base an opening is arranged between the free ends of the walls, between the base and the opening, there is the least one section in which the distance between the walls is smaller than in the adjacent regions toward the opening and toward the base.

In this case, the distance between the inner surfaces of the walls is larger in the region of the free ends of the walls and the ends of the walls at the base side than in at least one region situated in between.

The described configuration of the inner surfaces of the walls results in a "constriction" between the end at the base side (i.e., the location where the molten metal impacts) and the opposite open end (i.e., the location where the molten metal flows out). This "constriction" results in a constructive and functional separation of the component.

The kinetic energy of the molten metal is effectively reduced in the region between the base and the constriction. In addition, an uncontrolled splashing (uncontrolled backsplash) of the molten metal is prevented.

A diffusor is formed in the region between the constriction (neck) and the (upper) outlet end. The enlarged cross section at the outlet end is intended to prevent an interaction between the outflowing molten metal and the (centrally) introduced stream of molten metal. On the contrary, the dimensions should be chosen such that a fluidic calming of the molten metal returning to the outlet opening is achieved.

These functional specifications need to be adapted in accordance with the quantity, viscosity, temperature and/or velocity of the molten metal, for example, by choosing the space on the base side sufficiently large for the energy dissipation. This not only makes it possible to achieve the desired reduction of the kinetic energy of the molten metal, but also the preferred deflection of the stream of molten metal. At the upper outlet end of the component, a mostly laminar, calmed flow of the molten metal is desirable at least along the periphery.

According to a first embodiment, the angle of inclination lies between 10 and 80 degrees, wherein the angle of inclination in a further embodiment lies between 30 and 60 degrees.

The described inclination of the inner wall surfaces suffices, in principle, as long as the corresponding device (the component) is already filled with liquid molten metal. In a channel, a "V-shaped cross section of the conveying area" is formed for the molten metal at least above the constriction. When the mould is filled, the molten metal may splash uncontrollably depending on the angle of impact before it is conveyed upward from the base and out of the component. This is prevented with the above-mentioned reduced cross section between the walls (above the base).

In order to prevent an uncontrolled deflection, individual walls or several segments of the inner surfaces of said walls are realized with different angles of inclination.

This makes it possible to realize baffles, hydrodynamic brakes or flow guides on the inner walls of the component, as well as asymmetric geometries.

In one possible embodiment, the segments situated adjacent to the free end of the wall have a larger angle of inclination than the segments situated adjacent to the base of the component. In any case, the inside cross section of the component should become larger toward the free open end.

The individual inclined segments may follow each other directly (continuously) (also with different angles, as mentioned above). However, it is also possible to realize the inner surfaces of the walls with a sawtooth profile—in a cross-sectional view—such that "undercut zones" are formed on the wall which function as a hydrodynamic brake for the molten metal. The described constriction may be formed by such a "tooth geometry."

The inner wall surfaces may also contain rounded profile segments, profile segments that are directed toward one another or groove-like depressions.

With respect to a gutter, it is practical, for example, to realize the inner surfaces of the opposing walls in a laterally reversed fashion and, if applicable, to design the entire arrangement symmetrically.

Such an embodiment is also described in greater detail in the following description of the figures.

In addition to the aforementioned gutter shape, the component may also be realized in a pot-shaped fashion.

A curved design of the wall surfaces makes it possible to connect their ends such that a closed component is formed which has, for example, an oval or round inside cross section (and/or outside cross section). It would also be conceivable to provide at least two additional walls that connect the two described walls such that a (rectangular or polygonal) pot is formed.

With respect to fluidic considerations, rotationally symmetrical shapes are preferred.

Profiles of the peripheral inner wall may be realized in a screw-like, thread-like or spiral-like fashion.

The ratio height: width (of the interior limited by the walls) may vary broadly. This ratio usually lies between >2:1 and 1:4, but may easily be as high as 1:15. This also applies to the ratio height: maximum diameter in the previously described pot-shaped geometries.

In the described embodiments, in which the cross section of the opening between the walls on the outlet end for the molten metal is larger than on the base end, the component usually can be easily manufactured in one piece, for example, by means of casting or pressing. Any required undercuts may be produced during the manufacture, for example, with fillers that can be burnt out.

The design of the component can be adapted exactly and individually to the shape and properties (quantity, flow velocity, stream diameter of the molten metal being introduced) by selecting different angles of inclination and profiles along the inner walls, respectively. This also makes it possible to adjust the flow direction and the reduction of the kinetic energy.

Between deflecting surfaces, particularly surfaces that are inclined relative to the vertical, connecting surfaces may also be arranged horizontally (parallel to the base), vertically (perpendicular to the base), with an angle of inclination >90° referred to the vertical or with a curved profile.

Other characteristics of the invention are disclosed in the sub claims. The invention is described in greater detail below with reference to different embodiments.

Identical or equally acting parts are identified with the same reference symbols.

BEST MODES FOR CARRYING OUT INVENTION

Figure 1:
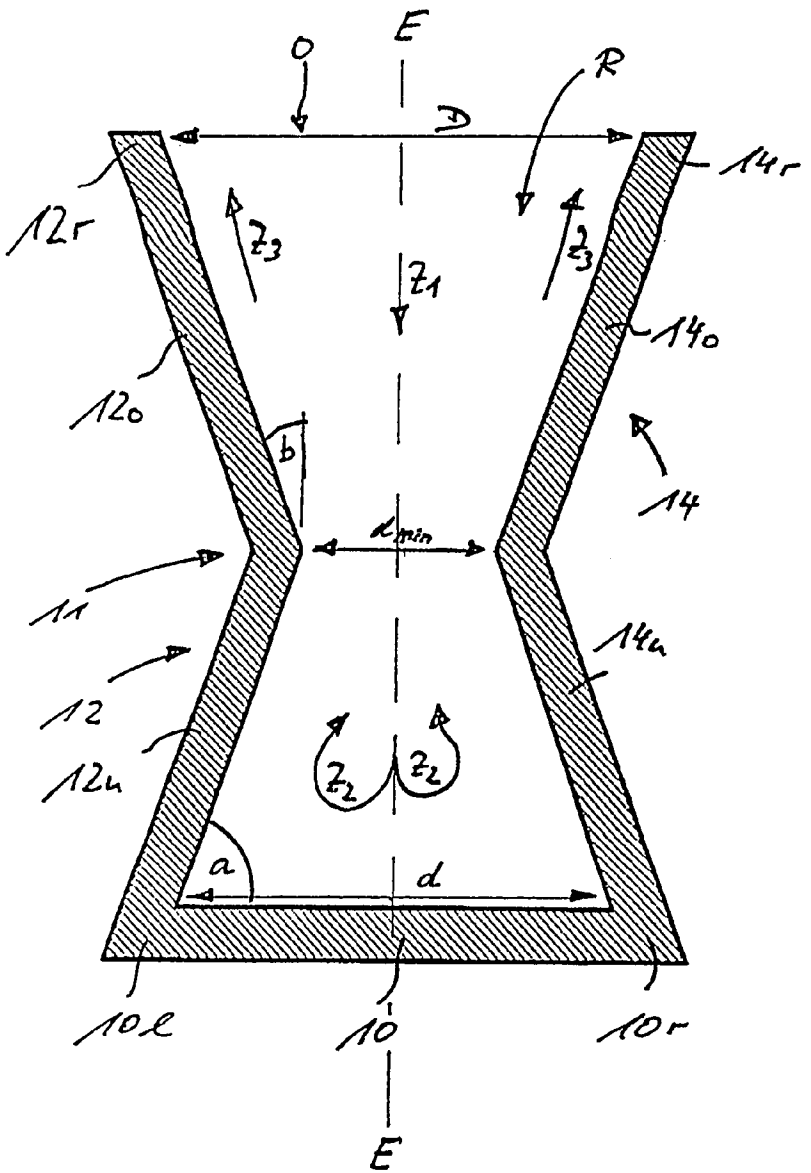
FIGS. 1–4 respectively show highly schematic representations of and cross sections through different embodiments of a component according to the invention Identical or equally acting parts are identified with the same reference symbols.

The embodiment according to FIG. 1 represents one possible geometry of a component according to the invention which has a base 10. Wall segments 12*u*, 14*u* of two walls 12, 14 extend in the same direction (namely upward) from opposing sections 10*l*, 10*r* of the base 10, however, with opposite inclinations. The walls initially converge (until a minimum distance $d_{min}$) is reached and then diverge (wall segments 12*o*, 14*o*).

The maximum distance between the lower wall segments 12*u*, 14*u* of the walls 12, 14 is identified by the reference symbol d, and the distance between the upper segments of the walls 12, 14 in the region of their free ends 12*r*, 14*r* is identified by the reference symbol D, wherein D and d are larger than $d_{min}$, and wherein D>d. The walls 12, 14 are realized in a laterally reversed fashion referred to an imaginary plane of symmetry E—E. The angle of inclination a of the lower segments of the walls 12, 14 is approximately 70° referred to the upper side of the base 10. The upper segments of the walls 12, 14 extend at an angle b of approximately 20° referred to a plane that lies parallel to the plane E—E.

The interior R of the component limited by the walls consequently has a cross-sectional geometry that resembles an egg timer.

The molten metal introduced in the direction of the arrow Z1 impacts on the base 10, is deflected in the direction of the arrow Z2 and ultimately conveyed upwardly along the wall in the direction of the arrow Z3, until it flows along the outer edge 12*r*, 14*r* of the wall.

The kinetic energy of the introduced molten metal is dissipated between the base 10 and the above-described constriction 11. The tapered cross section simultaneously prevents the molten metal from splashing uncontrollably. A diffusor zone is formed in the section between the constriction 11 and the upper opening O (between the inner surfaces of the edge segments 12*r*, 14*r*), wherein the molten metal is able to flow out of the component along the wall in a laminar flow while fresh molten metal can be centrally (in accordance with arrow Z1) introduced into the component.

The component shown in FIG. 1 is realized in the form of a gutter.

Figure 2:
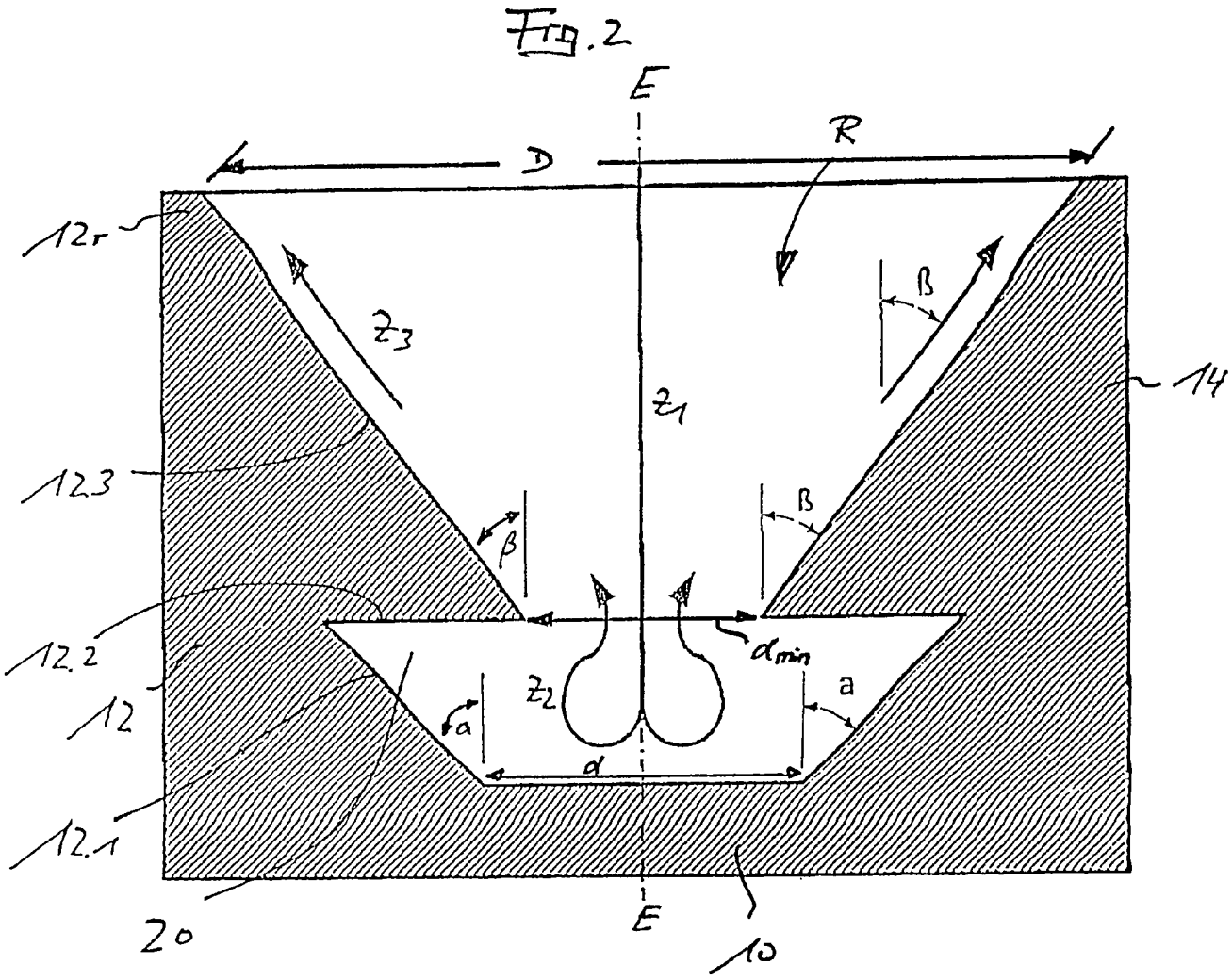

This also applies to the component shown in FIG. 2. This component is also realized in a laterally reversed fashion referred to a plane of symmetry E. Consequently, the additional geometry is only described with reference to the (left) wall 12 and applies analogously to the wall 14.

The first inner wall segment 12.1 initially extends from the base 10 at an angle a of approximately 45 degrees referred to the plane E—E. This segment is followed by a segment 12.2 that extends parallel to the base 10, namely inwardly (in the direction of the opposing wall 14). This segment 12.2 is followed by another segment 12.3 that extends up to the upper edge 12*r* of the wall 12 at an angle β of approximately 40 degrees referred to the plane E—E. This means that the smallest distance $d_{min}$ between the walls lies between the segments 12.2 and 12.3.

The interior R of this component consequently has an essentially V-shaped geometry between the base 10 and the outer edge 12*r*, 14*r*, however, with an undercut zone 20. This undercut zone leads to a controlled deflection of the introduced molten metal, and the deflected stream of molten metal is subjected to a turbulent motion. This causes the molten metal to lose its flow direction. Thus the kinetic energy is mostly reduced immediately after casting has started and continues to do so.

Figure 3:
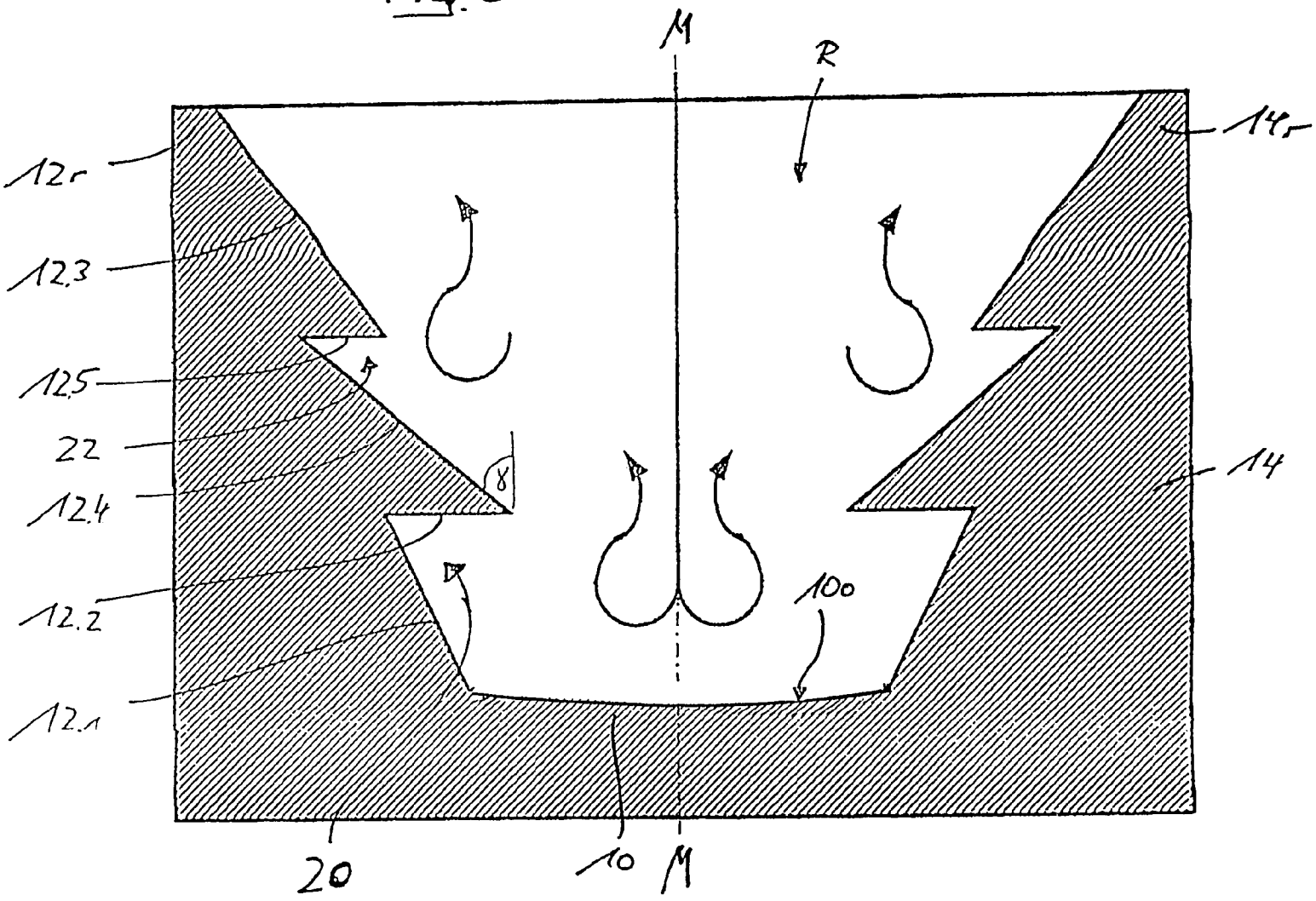

The embodiment according to FIG. 3 is realized similar to that shown in FIG. 2, wherein the component shown in this embodiment is designed, however, as a rotationally symmetrical pot-like component, i.e., an impact pot. The rotationally symmetrical design refers to an imaginary longitudinal center line M—M.

Different to the embodiment according to FIG. 2, the inner wall 12 is characterized by another inclined segment 12.4 and another horizontally extending segment 12.5 between the segments 12.1 and 12.3. This results in another undercut zone 22. The angle of inclination γ of the segment 12.4 is larger than the angle of inclination β of the segment 12.3.

In the context of the invention, the opposing wall surface shown in FIG. 3 could be referred to as the wall surface 14. Technically speaking, this naturally is the same wall surface 12 as that shown in the left portion of the figure because this wall extends around the periphery of the described pot geometry.

The base 10 has a dome-shaped surface 10*o* that could also be curved in the opposite direction.

Figure 4:
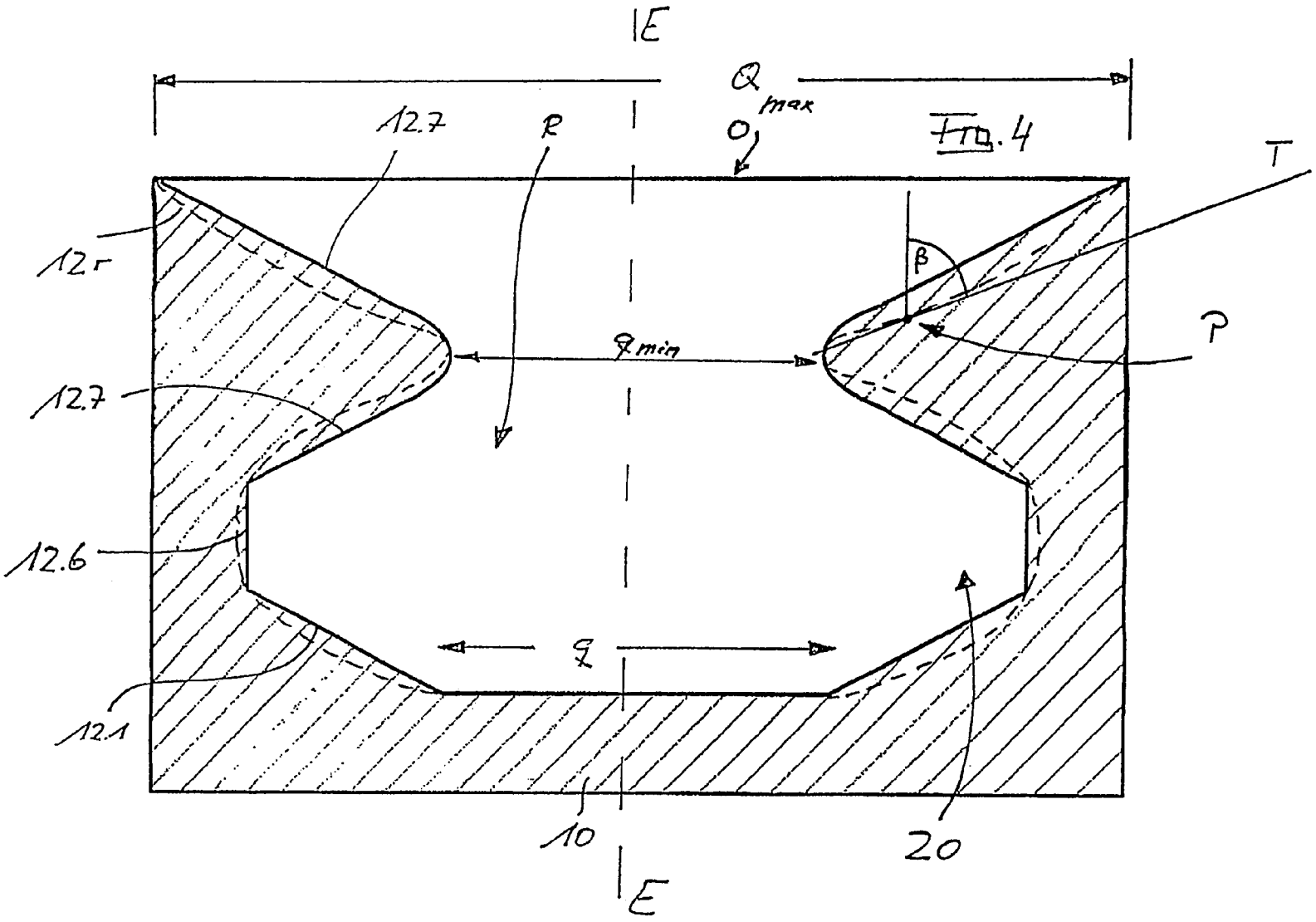

FIG. 4 shows another embodiment of an impact pot. In this case, a wall segment 12.6 that extends perpendicular to the base 10 is connected to a lower inclined wall segment 12.1 and followed by a bead-like inner wall surface 12.7 that widens outward in the direction of the free outer edge 12*r* of the impact pot. Consequently, the upper free end of the splash pot has a significantly larger inside diameter Q than the region of the impact surface 24 of the base 10 (diameter q). The smallest cross section (qmin) of the interior R again lies between the base region 10 and the opening O in this case.

The geometry shown in FIG. 4 also results in a peripheral undercut (groove-like) zone 20 that serves for deflecting and calming the molten metal, as well as for dissipating its kinetic energy.

The component can be manufactured in one piece from a casting mass (for example, on the basis of $Al_2O_3$).

FIG. 4 shows—with broken lines—a possible modification. In this case, the wall segments 12.1, 12.6 and 12.7 are connected in a more or less straight fashion and smoothly transform into one another, wherein the part of the wall segment 12.7 that is directed toward the opening O is provided with an additional concave curvature. The invention also includes embodiments, in which this surface segment is curved in the opposite direction (convex curvature).

Generally speaking, one or more inner base and wall surface(s) of the described impact element (component) may extend straight or curved, namely with a convex or concave curvature and even such that they transform into one another, wherein said base and wall surface(s) may also have the same or different angles of inclination/curvature radii. This makes it possible to adapt the flow characteristics of the molten metal to the respective application.

If the straight wall segments shown in FIG. 4 which form an angle of >0 and <90° referred to the plane E—E are replaced with curved wall segments, the entire wall segment is inclined relative to the plane E—E by more than one angle. In this case, the angle of inclination β of the respective part of the wall segment referred to the plane E—E is defined for each point of the inner contour of the wall segment by the angle between the tangent in the respective point and the plane.

Due to their curvature, the curved wall segments 12.1, 12.6 and 12.7 respectively extend at different angles relative to the plane E—E.

For example, a tangent T is drawn at the point P that lies on the surface segment 12.7 pointing to the opening O in FIG. 4. In the point P, the surface segment 12.7 is angled relative to the plane E—E by an angle β of approximately 80 degrees.

The invention claimed is:

1. A refractory ceramic component with the following characteristics:

1.1 a base, 1.2 at least two walls, 1.3 the walls extend from opposing sections of the base such that at least segments of their inner surfaces are oppositely inclined by an angle of >0 and <90 degrees referred to a plane that extends perpendicular to the base, 1.4 an opening is arranged between the free ends of the walls, 1.5 between the base and the opening, there is at least one section in which the distance between the walls is smaller than in the adjacent regions towards the opening and towards the base, and 1.6 wherein a flow of molten metal introduced downwardly into the component deflects according to said inclined inner surfaces of said component producing at least one turbulent flow that reduces kinetic energy of said downward flow of molten metal.

2. The component according to claim 1, wherein each inner surface comprises several segments with different angles of inclination.

3. The component according to claim 1, wherein each inner surface comprises several segments with different angles of inclination, and wherein the segment situated adjacent to the free end of the walls is inclined by a larger angle of inclination than the segment situated adjacent to the base.

4. The component according to claim 1, wherein the inner surfaces of the walls have a sawtooth profile—if viewed in the form of a section.

5. The component according to claim 1, wherein the inner surfaces of the walls have rounded profile segments that are directed toward one another.

6. The component according to claim 1, wherein the inner surfaces of the walls have at least one groove-like depression.

7. The component according to claim 6, wherein the groove-like depression is inclined in its longitudinal direction.

8. The component according to claim 1, wherein opposing inner surfaces of the walls are realized in a laterally reversed fashion.

9. The component according to claim 1 in the form of a gutter with an open top.

10. The component according to claim 1 with at least two additional walls are provided which connect the two walls such that the component has a pot-shaped geometry.

11. The component according to claim 1, wherein the component has the shape of a pot of oval, rectangular or circular geometry if viewed in the form of a top view.

12. The component according to claim 1, wherein the ratio height: width or height: maximum diameter of the space enclosed by the walls lies between 2:1 and 1:4.

13. The component according to claim 1, wherein the ratio height: width or height: maximum diameter of the space enclosed by the walls is as high as 1:15.

14. The component according to claim 1, wherein the inner surfaces of the walls have an angle of inclination between 10 and 80 degrees.

15. The component according to claim 1, wherein the inner surfaces of the walls have an angle of inclination between 30 and 60 degrees.

16. The component according to claim 1, realized as a one-piece component.

17. The component according to claim 1, wherein the component has a calotte-shaped base.

18. The component according to claim 1, wherein the distance between the inner surfaces of the walls increases toward their free ends.

19. The component according to claim 1, wherein the distance between the inner surfaces of the walls is greater in the region of the free ends and in the region of the ends of the walls at the base side than in at least one region situated in between.

* * * * *